United States Patent [19]

Binninger et al.

[11] Patent Number: 4,463,781

[45] Date of Patent: Aug. 7, 1984

[54] PICK-FINDING DEVICE FOR A WEAVING MACHINE

[75] Inventors: August Binninger, Geisingen, Fed. Rep. of Germany; Josef Kieliger, Spartanburg, S.C.

[73] Assignee: Sulzer Brothers, Ltd., Winterthur, Switzerland

[21] Appl. No.: 449,845

[22] Filed: Dec. 15, 1982

[30] Foreign Application Priority Data

Dec. 16, 1981 [CH] Switzerland ..... 8018/81

[51] Int. Cl.[3] ..... D03C 3/28; D03D 51/08

[52] U.S. Cl. ..... 139/1 E; 139/336

[58] Field of Search ..... 139/1 E, 1 R, 336, 329; 74/812, 126

[56] References Cited

FOREIGN PATENT DOCUMENTS

| | | | |
|---|---|---|---|
| 489644 | 6/1970 | Switzerland | 139/1 E |
| 502538 | 3/1939 | United Kingdom | 139/336 |
| 732895 | 6/1955 | United Kingdom | 139/329 |
| 433257 | 12/1974 | U.S.S.R. | 139/1 E |
| 724611 | 3/1980 | U.S.S.R. | 139/1 E |

*Primary Examiner*—James Kee Chi

*Attorney, Agent, or Firm*—Kenyon & Kenyon

[57] ABSTRACT

The pick-finding device has a planetary transmission for turning back the weaving units into their proper operative position relative to the weaving machine. The input shaft and output shaft of the transmission run in the same direction and at the same speed as one another. In addition, an indexing means is provided to supervise the range of adjustment of the control motors in accordance with the required range of adjustment of the weaving units.

11 Claims, 11 Drawing Figures

PICK-FINDING DEVICE FOR A WEAVING MACHINE

Figure 1:
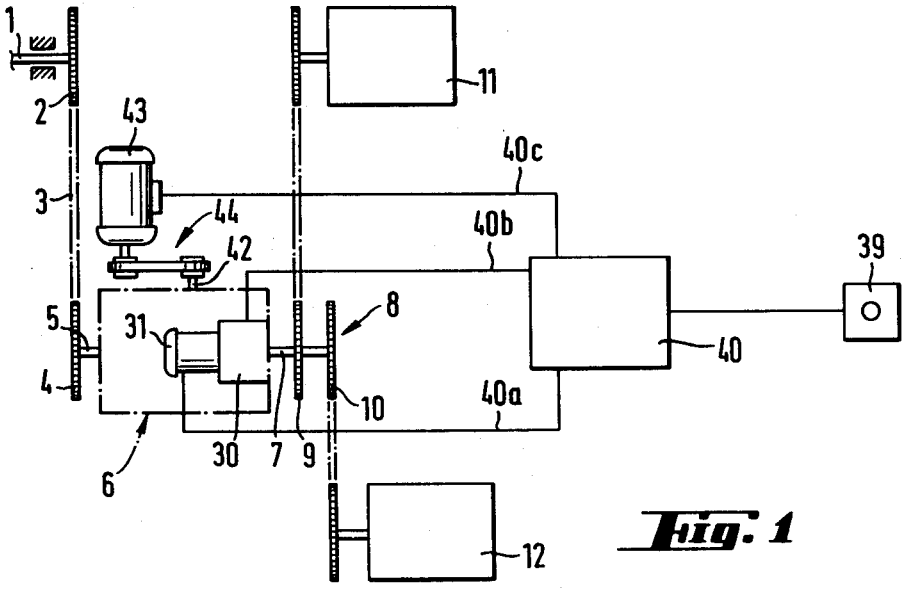

This invention relates to a pick-finding device for a weaving machine.

As is known, weaving machines are usually provided with a weft detector for detecting a mis-pick during weaving so that, in the event of a mis-pick, the weft detector can output a signal for stopping a driving motor of the weaving machine immediately while braking the machine to a stop. Thereafter, the faulty weft can be removed from an opened shed. In order to again pick a weft yarn into the open shed, the various units which make up the weaving machine must then be set back by one weft. This operation is usually referred to as pick-finding.

As is known from German Offenlegungsschrift No. 2,545,903, weaving machines have been provided with a pick-finding device which resets the various units of the weaving machine at the press of a button. However, such a device, which has a differential transmission, has a disadvantage in that the output speed of the device must be one-half of that of the input speed during weaving. Consequently, when the device is fitted to an existing weaving machine, action must be taken to insure that the driven units run at the proper speed. Another disadvantage is that a phase shift remains in pick-finding between the operative position of the turn-back units and the weaving machine due to the run-out time of the motor driving the pick-finding device.

Accordingly, it is an object of the invention to provide a pick-finding device having an output speed equal to the input speed.

It is another object of the invention to provide a pick-finding device which is free from phase shift.

It is another object of the invention to provide a pick-finding device of relatively simple construction.

Briefly, the invention provides a pick-finding device for a weaving machine which comprises a planetary transmission including an input drive gear set and an oppositely driven output drive gear set having an output gear therein. In addition, the device has a second transmission for selectively driving the output gear for pick-finding, a control motor for driving the second transmission and an indexing means for selectively holding the output gear in a stationary position during operation of the planetary transmission and for releasing the output gear during operation of the second transmission.

The pick-finding device is disposed within the weaving machine between a main shaft and one or more weaving units which are driven off the main shaft.

During normal operation of the weaving machine, the planetary transmission forms a connection between the main shaft and the weaving units in order to drive the weaving units in a forward manner. In the event that a mis-pick occurs, the main shaft is stopped. At the same time, the indexing means is actuated so that the output gear of the planetary transmission is released and the control motor actuated to drive the second transmission. In this way, the output gear is again driven so as to drive at least one of the weaving units, for example, in a reverse manner for pick-finding.

The indexing means may be constructed with a rotary indexing disc, an indexing pin which can selectively engage the disc to prevent rotation and a third planetary transmission connected between and to the output gear and the disc in order hold the output gear in the stationary position in response to the pin engaging the disc. The index pin may also be positioned so as to be selectively engageable in the output gear when the output gear is in the stationary position.

The pick-finding device also includes a control device for actuating the indexing means and the control motor in sequence. In this regard, a common control device can be connected to a multiplicity of control motors for a multiplicity of transmissions for driving different weaving units of the weaving machine. In this case, the common control device may be provided with a program means for controlling the direction and movement of each control motor and, in turn, each weaving unit which is to be actuated for pick-finding.

Figure 7:
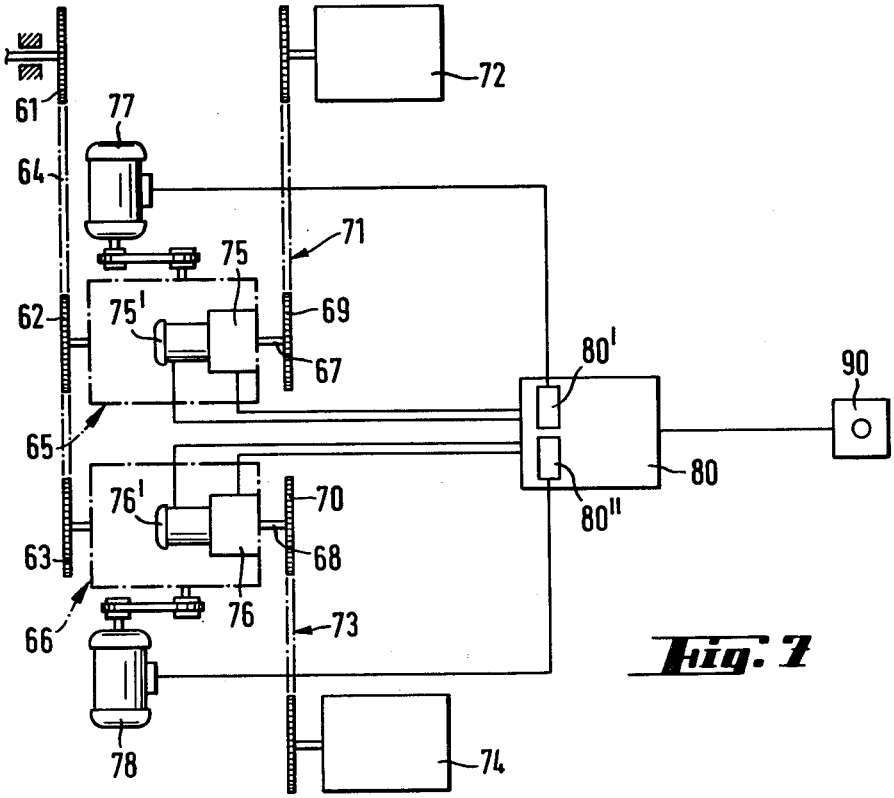
Figure 2:
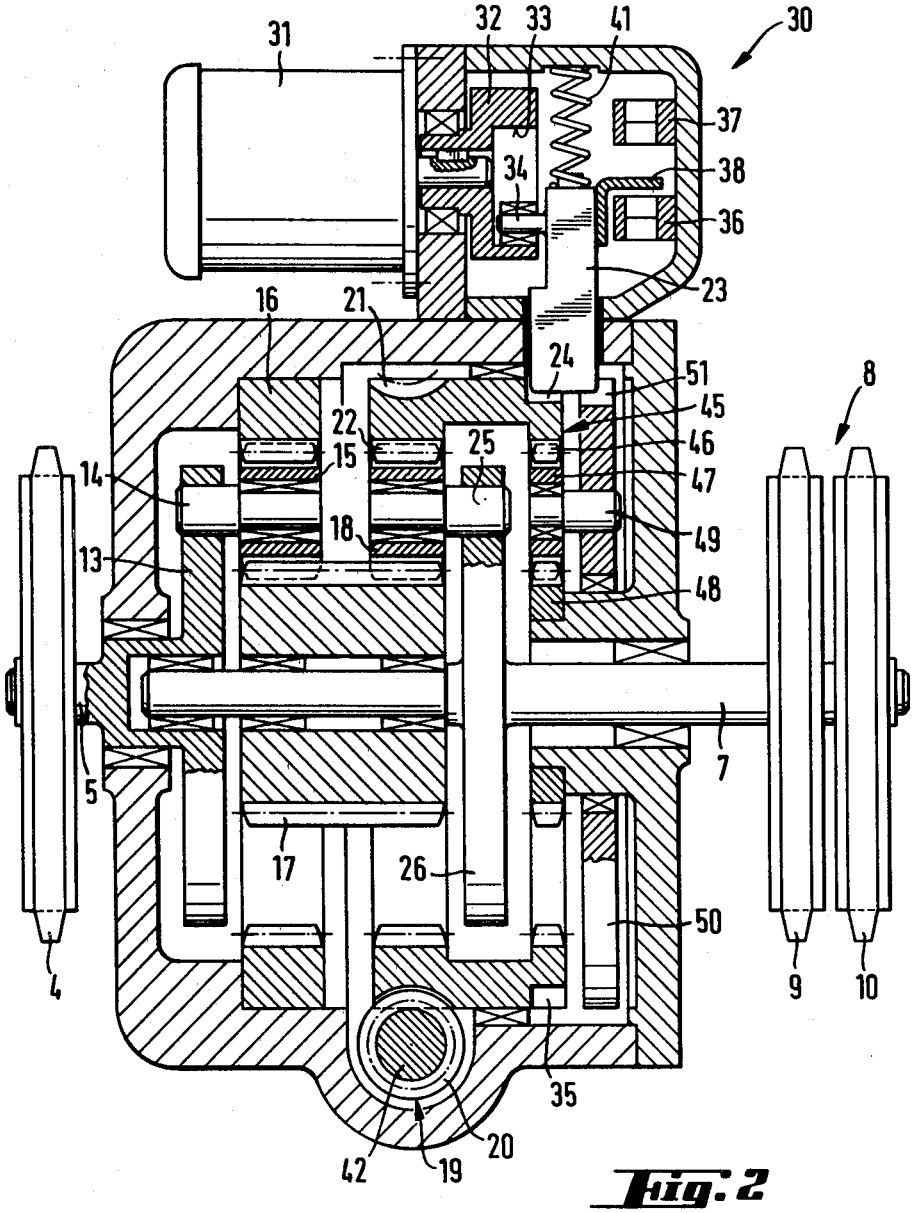
Figure 3A:
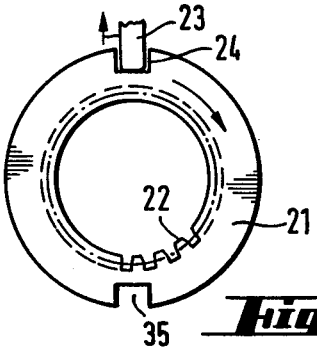
Figure 3B:
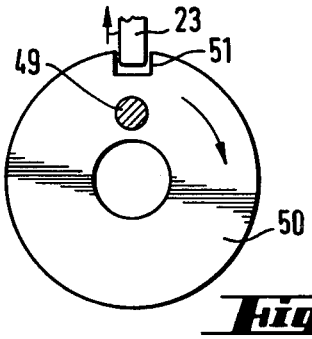

These and other objects and advantages of the invention will become more apparent from the following detailed description taken in conjunction with the drawings wherein:

FIG. 1 schematically illustrates a pick-finding device according to the invention;

FIG. 2 illustrates a cross-sectional view of the various transmissions of the pick-finding device of FIG. 1;

FIG. 3*a* illustrates a view of an output gear according to the invention;

FIG. 3*b* illustrates a view of an indexing disc in accordance with the invention;

FIGS. 4*a*, 4*b*, 5*a*, 5*b*, 6*a* and 6*b* illustrate various related positions of the output gear and indexing disc in one embodiment of the pick-finding device of the invention; and FIG. 7 illustrates a multiple pick-finding device constructed in accordance with the invention.

Referring to FIG. 1, a weaving machine (not shown) has a main shaft 1 from which various weaving units 11, 12 of the machine can be driven. As indicated, a pick-finding device is disposed between the main shaft 1 and the weaving units 11, 12. This pick-finding device includes a planetary transmission 6 which is connected to the main shaft 1 via a sprocket 2 on the main shaft, a sprocket 4 on a shaft 5 of the transmission 6 and a chain 3 about the sprockets 2, 4. The transmission 6 is connected to the units 11, 12 via an output shaft 7 which carries a double sprocket 8 formed by two component sprockets 9, 10. As indicated, each sprocket 9, 10 drives a respective weaving unit 11, 12. The weaving units 11, 12 may, for instance, be a cloth-stepping unit and a shedding mechanism. A third unit such as a color control mechanism (not shown) may also be driven by the sprockets or the shedding mechanism.

The transmission 6 is such that the input sprocket 4 and the output double sprocket 8 run in the same direction and at the same speed during weaving. The transmission 6 can therefor be readily fitted to an existing weaving machine.

Referring to FIG. 2, the transmission 6 includes an input drive gear set defined by a carrier 13 which is secured to the input shaft 5 and which carries a pivot pin 14, a planetary gear or satellite 15 which is rotatably mounted on the pivot pin 14, a stationary ring gear or annulus 16 which is fixed within a housing of the transmission and a drive gear such as a sun wheel 17. In addition, the transmission 6 includes an oppositely driven output gear set having a planetary gear 18 with the same number of teeth as the planetary gear 15 meshing with the sun wheel 17 and an output gear 22, e.g. an annulus, having an internally toothed ring with the same number of teeth as the annulus 16 meshing with the planetary gear 18. As shown, the planetary gear 18 is mounted on a pin 25 secured in a flange or carrier 26 on the output shaft 7. The output gear 22 also has a worm gear 21 formed on the external periphery for purposes as described below.

The pick-finding device also has an indexing means 30 for selectively holding the output gear 22 in a stationary position during driving of the weaving units 11, 12, for example in a forward manner. This indexing means 30 includes an indexing pin 23 which is biased by a spring 41 into a recess 24 in the output gear 22 in order to hold the output gear 22 in the stationary position.

When the output gear 22 is fixed in the stationary position via the indexing pin 23, the main shaft 1 (see FIG. 1) is able to drive the shaft 5 of the transmission 6 at a particular speed and in a particular direction. At this time, the transmission 6 drives the output shaft 7. Since the drive gear set 15, 16, 17 and the driven gear set 17, 18, 22 are identical and are driven in opposite directions, the sprockets 4, 8 run in the same direction and at the same speed as one another.

The pick-finding device is also provided with a second transmission for selectively driving the output gear 22 in a reverse manner for pick-finding. To this end, the second transmission is a worm drive 19 comprising a worm 20 and the worm gear 21 on the output gear 22.

In addition, a control motor 43 (see FIG. 1) is provided for driving the worm drive 19. This control motor 43 drives a shaft 42 on which the worm 20 of the worm drive 19 is secured via a belt drive 44 (see FIG. 1).

Referring to FIG. 2, the indexing device 30 is constructed so as to control the rotation of the worm gear 21. To this end, the indexing means 30 includes an indexing motor 31 having a shaft on which a disc 32 with an internal cam 33 is secured. In addition, a roller 34 which is mounted on the indexing pin 23 is guided on the cam 33 such that upon rotation of the disc 32, the indexing pin 23 can be raised against the bias of the spring 41.

The output gear 22 is also provided with a recess 35 which is diametrically opposite the recess 24 as shown in FIG. 3*a*. Depending upon the position of the worm gear 21, the index pin 23 can engage with one or the other recess 24, 35.

As shown in FIG. 2, the indexing means 30 is also provided with two sensors 36, 37 which detect the position of the index pin 23 inside and outside the recesses 24, 35. These sensors 36, 37 cooperate with a switching tag or lug 38 which is secured to the pin 23.

Referring to FIG. 1, a control device 40 is provided for actuating the indexing means 30 and the control motor 43 in sequence. As indicated, the control device has one output which is connected by a line 40*a* to the indexing motor 31 for emitting a signal thereto to release the indexing pin 23 from the output gear 22. In addition, the control device has an input which is connected via a line 40*b* to the indexing means to receive a signal therefrom in response to the release of the output gear as well as a second output which is connected to the control motor 43 via a line 40*c* in order to emit a signal thereto for actuation of the motor 43 in response to the signal in the input line 40*b*. The control device 40 may be actuated by a switch 39.

In order to carry out a pick-finding operation, the device operates as follows:

When a weft detector (not shown) of the weaving machine has detected a mis-pick and the subsequent knocking-off motion has stopped the drive motor (not shown), the weaving machine and all the weaving units (including units 11, 12) stop. Consequently, the sprocket 4, shaft 5, carrier 13, planetary gear 15 and sun wheel 17 stop. The machine operator then removes the weft from the shed (not shown) and closes the switch 39 to start the control device 40 to initiate pick-finding.

Upon actuation of the control device 40, a signal is emitted via the line 40*a* to the indexing motor 31 so that the disc 32 withdraws the indexing pin 23 from the recess 24 in the output gear 22. The tag or lug 38 then causes the sensor 37 to output a signal via the line 40*b* to the control device 40 which responds by starting the control motor 43 via the line 40*c*. The motor 43 then drives the shaft 42 via the belt drive 44 so that the worm 20 is able to rotate the worm gear 21. The internal teeth of the output gear 22 thus drive the planetary gear 18 which rolls on the stationary sun wheel 17 and, by way of the pivot 25 and carrier 26, the shaft 7. The shaft 7, in turn, drives the double sprocket 8. The double sprocket 8, however, is now driven in a reverse direction, i.e., the opposite direction as compared with the direction in which the sprocket 8 runs during weaving. Consequently, the sprocket 8 turns back the two weaving units 11, 12 into the proper operative position relative to the weaving machine at the speed of the motor 43, as changed by the worm drive 19 and output gear set 17, 18, 22.

During this time, the disc 32 rotates through one complete revolution and the control device 40 stops the indexing motor 31. At the end of the revolution, the disc 31 releases the pin 23 so that the pin may engage in the worm wheel 21. However, in the illustrated embodiment, the pin 23 cannot engage in the recess 24 since the worm wheel 21 has not rotated through a similar revolution as does the sprocket 8.

In order to insure that the weaving units 11, 12 are turned back by exactly one weft, thus obviating phase shift between their operative position and the weaving machine, the rotation of the double sprocket 8 in the opposite direction must be exactly one revolution. The number of rotations which the worm gear 21 must make for this purpose depends upon the reduction ratio provided by the output gear set 17, 18, 22. It is assumed in the present embodiment that the worm gear 21 must make one and a half revolutions; however, other ratios are possible.

In order to prevent a premature engagement of the indexing pin 23 in the second recess 35 of the worm gear 21, the indexing means 30 is provided with a rotatable indexing disc 50 which has a recess 51 for receiving the indexing pin 23. The indexing disc 51 is driven by a second planetary transmission 45 which is provided in the casing for the planetary transmission 6. The second planetary transmission 45 includes a second internally toothed ring 46 which serves as an annulus in the worm gear 21 and a satellite or planetary gear 47 having the same number of teeth as the planetary gear 18. The planetary gear 47 meshes with the toothed ring 46 as well a stationary sun gear 48 which has the same number of teeth as the sun gear 17. The planetary gear 47 is also rotatably mounted on a pin 49 which is secured in the indexing disc 50. Consequently, during pick-finding, the disc 50 rotates synchronously with the double sprocket 8. That is, one revolution of the disc 50 corresponds to one revolution of the double sprocket 8.

The relative movements and cooperation between the worm gear 21 and the indexing disc 50 during pick-finding is illustrated in FIGS. 3*a*, 3*b*–6*a*, 6*b*. That is, as indicated in FIGS. 3*a* and 3*b*, at the start of pick-finding, the indexing pin 23 is removed from the recess 24 in the worm gear 21. At the same time, the indexing pin 23 is removed from the recess 51 in the indexing disc 50. Thereafter, the worm gear 21 and disc 50 start to rotate under the influence of the worm drive 19 (see FIG. 2).

Figure 4A:
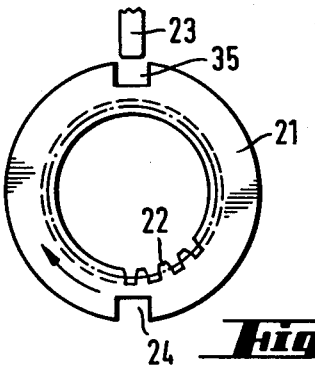
Figure 4B:
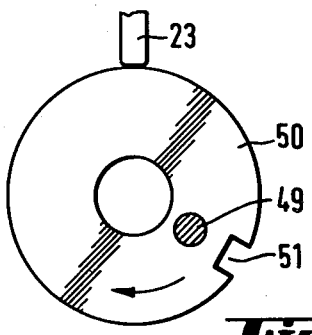

After the worm gear 21 has rotated through 180° (FIG. 4*a*) the pin 23 could drop into the recess 35 but is prevented from doing so by the disc 50 since the disc has moved only through 120° (FIG. 4*b*).

Figure 5A:
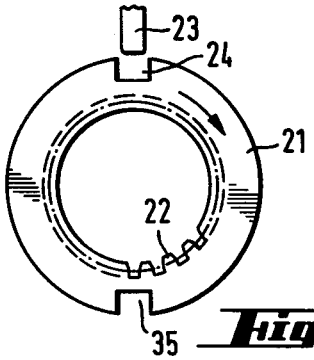
Figure 5B:
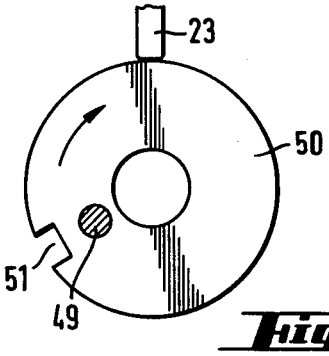
Figure 6A:
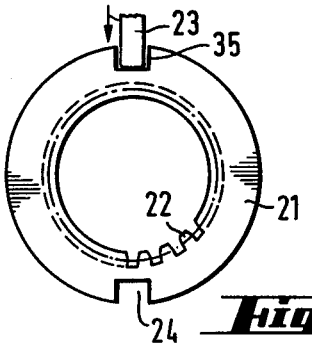
Figure 6B:
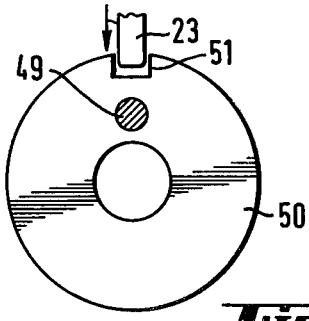

After the worm gear 21 has rotated through 360° (FIG. 5*a*), the disc 50 still prevents the pin 23 from dropping into the recess 24 (see FIG. 5*b*).

After the worm gear has rotated through 540° or one and a half revolutions (FIG. 6*a*),the recesses 35, 51 are aligned and permit the pin 23 to be engaged in the recess 24 under the force of the spring 41 (FIG. 1). The disc 50 and double sprocket 8 have then been rotated through one revolution each—corresponding to turning of the weaving units 11, 12 back by one weft.

The indexing means 30 can also be constructed so that the indexing of the worm gear 21 is supervised only by the disc 50. In this event, the worm gear 21 is void of the peripheral recesses 24, 35 and the pin 23 engages only in the recess 51 of the disc 50. After the pin 23 has engaged in the disc 50, the worm gear 21 would be blocked via the stationary sun gear 48, stationary planetary gear 47 and annulus 46.

Of note, instead of using a worm drive 19, other types of gearing such as using pinions, can be used. In this event, an outward gear would replace the worm gear 21.

It has been assumed for the purposes of the above-described embodiment that both the weaving units 11, 12 must be turned back through one revolution in order to set back one weft. However, it may be necessary for the units to move differently from one another during pick-finding. For instance, one unit may have to be turned back one revolution while the other unit is turned forwards two revolutions. In this event, two pick-finding devices are required.

Referring to FIG. 7, a multiple pick-finding device may be provided with a chain drive comprised of sprockets 61, 62, 63 and a roller chain 64 for driving two planetary transmissions 65, 66. As indicated, each transmission 65, 66 has an output shaft 67, 68 which drives a respective sprocket 69, 70. One sprocket 69 is part of a chain drive 71 for driving one unit 72 while the other sprocket 70 is part of a chain drive 73 for driving another weaving unit 74.

As indicated, one transmission 65 has an indexing means 75 with an indexing motor 75' while the other transmission 66 has an indexing means 76 with an indexing motor 76'. In addition, a final control motor 77, 78 is associated with each transmission 65, 66 respectively.

The construction of the transmissions 65, 66, indexing means 75, 76 and control motors 77, 78 is as described above.

In addition, a common control device 80 is provided for controlling the indexing means 75, 76 and the motor 77, 78. As indicated, this control device 80 is actuated by a switch 90.

The control device includes a program means or program store 80', 80'' for each of the respective units 72, 74. Each program means contains data for controlling the direction and movement of each control motor with respect to the movements which the respective units 72, 74 must make during pick-finding. Each unit 72, 74 is thus independent of the other as regards to the number of forward and backward rotations which must be made during pick-finding until they have reached the proper position in which weaving can be resumed.

During operation of the multiple pick-finding device, the sprockets 62, 63 are first brought to a stationary position upon stopping of the weaving machine at the start of pick-finding. The switch 90 is then closed to start the control device 80 and the program thereof for the movements of the weaving units 72, 74. Thereafter, the indexing motors 75', 76' for the indexing means 75, 76 are started by the respective programs so that the indexing means are unlocked. Next, the motors 77, 78 are started and, in accordance with the program, start up the worm drives in each planetary transmission 65, 66 so that the sprockets 69, 70 run in a direction and at a speed suitable for moving the units 72, 74 into the proper operative position relative to the weaving machine. The control motors 77, 78 stop at the end of the program.

The invention thus provides a pick-finding device of simple construction which permits an output shaft to run at the same speed as an input shaft. In addition, the pick-finding device is free from phase shift between the weaving units and the weaving machine. Due, for example to the runout of the final control motor.

What is claimed is:

1. A pick-finding device for a weaving machine having a main shaft and plurality of weaving units driven-off said main shaft, said device comprising a first planetary transmission for connection between the main shaft and the weaving units for driving the weaving units in a forward manner, said transmission including an input drive gear set and an oppositely driven output gear set, said output gear set having an output gear therein;

a second transmission for selectively driving said output gear to drive at least one weaving unit in a reverse manner for pick-finding;

a control motor for driving said second transmission; and an indexing means for selectively holding said output gear in a stationary position during driving of the weaving units in the forward manner and for releasing said output gear during driving of at least one of the weaving units in the reverse manner.

2. A pick-finding device as set forth in claim 1 wherein said indexing means includes a rotatable indexing disc, an indexing pin for selectively engaging said disc to prevent rotation thereof and a third planetary transmission connected between and to said output gear and said disc to hold said output gear in said stationary position in response to said index pin engaging said disc.

3. A pick-finding device as set forth in claim 2 wherein said index pin is selectively engageable in said output gear in said stationary position of said output gear.

4. A pick-finding device as set forth in claim 1 which further comprises a third transmission for connection between the main shaft and at least one other weaving unit for driving the weaving unit, said third transmission having an output gear set including an output gear;

a fourth transmission for selectively driving said output gear of said third transmission;

a second control motor for driving said fourth transmission; and a common control device connected to each of said control motors, said common control device including a program means for controlling the direction and movement of each control motor.

5. A pick-finding device for a weaving machine comprising a first planetary transmission including an input drive gear set and an oppositely driven output drive gear set having an output gear therein;

a second transmission for selectively driving said output gear for pick-finding;

a control motor for driving said second transmission; and an indexing means for selectively holding said output gear in a stationary position during operation of said first planetary transmission and for releasing said output gear during operation of said second transmission.

6. A pick-finding device as set forth in claim 5 which further comprises a control device for actuating said indexing means and said control motor in sequence, said control device having one output connected to said indexing means for emitting a signal thereto to release said indexing means from said output gear, an input connected to said indexing means to receive a signal therefrom in response to release of said output gear and a second output connected to said control motor to emit a signal thereto to actuate said control motor in response to said signal at said input.

7. A pick-finding device as set forth in claim 5 wherein said output gear is an annulus.

8. A pick-finding device as set forth in claim 7 wherein said second transmission is a worm drive and said annulus has a worm gear in engagement with said worm drive.

9. A pick-finding device as set forth in claim 5 wherein said indexing means includes a rotatable indexing disc, an indexing pin for selectively engaging said disc to prevent rotation thereof and a third planetary transmission connected between and to said output gear and said disc to hold said output gear in said stationary position in response to said index pin engaging said disc.

10. A pick-finding device as set forth in claim 9 wherein said index pin is selectively engageable in said output gear in said stationary position of said output gear.

11. A pick-finding device as set forth in claim 10 wherein said output gear has a multiplicity of slots for selectively receiving said index pin and said disc has a single slot for receiving said index pin whereby the rotation of said output gear is maintained in a predetermined ratio relative to the rotation of said disc.

* * * * *